United States Patent [19]

Baba et al.

[11] 4,220,025

[45] Sep. 2, 1980

[54] FEED FORWARD AUTOMATIC THICKNESS CONTROLLING METHOD

[75] Inventors: Kazushi Baba; Hisashi Miura, both of Kurashiki; Yoshiharu Tominaga, Kobe, all of Japan

[73] Assignees: Mitsubishi Denki Kabushiki Kaisha, Tokyo; Kawasaki Steel Corporation, Kobe, both of Japan

[21] Appl. No.: 962,663

[22] Filed: Nov. 21, 1978

[30] Foreign Application Priority Data

Nov. 21, 1977 [JP] Japan ..... 52-139706

[51] Int. Cl.[2] ..... B21B 37/12

[52] U.S. Cl. ..... 72/8; 72/16

[58] Field of Search ..... 72/6, 7, 8, 19, 16, 72/21

[56] References Cited

U.S. PATENT DOCUMENTS

| | | | |
|---|---|---|---|
| 3,266,279 | 8/1966 | Wright | 72/8 |
| 3,269,160 | 8/1966 | Halter et al. | 72/8 |

FOREIGN PATENT DOCUMENTS 49-75443 of 1974 Japan .

*Primary Examiner*—Milton S. Mehr

*Attorney, Agent, or Firm*—Oblon, Fisher, Spivak, McClelland & Maier

[57] ABSTRACT

In a steel rolling mill, (a) a calibration of a thickness in the output side which is calculated from a rolling force at a lock-on position in the present pass is performed depending upon a fluctuation from a predetermined thickness at the lock-on in the last pass, a deformation resistance of a slab and a mill constant; and (b) a constant lock-on level is given to be a predetermined thickness in the present pass as the same with a thickness in the output side given by a plastic characteristic curve of the rolled slab on the predetermined thickness at the lock-on in the last pass and an elastic characteristic curve of a rolling mill on a screw position in the present pass; and then, (c) an adjusting degree of a screw gap of the press-down screw is obtained depending upon the thickness fluctuation from the predetermined thickness in the last pass, the mill constant and a differential coefficient in a rolling load function from the predetermined thickness in the present pass; and (d) the press-down screw position is controlled depending upon the adjusting degree.

The press-down screw position is controlled at the position corresponding to the position of the rolled slab in the last pass (a) depending upon the adjusting degree by gaining for a time delay of the screw gap adjusting system comprising the press-down screw from the position corresponding to the position of the rolled slab in the last pass or (b) depending upon the adjusting degree at the position corresponding to the position of the rolled slab in the last pass by providing a phase gain compensation to the time constant in the screw gap adjusting system.

3 Claims, 4 Drawing Figures

FEED FORWARD AUTOMATIC THICKNESS CONTROLLING METHOD

BACKGROUND OF THE INVENTION

The present invention relates a feed forward automatic thickness controlling method which is suitable for controlling a thickness of a rolled slab in a lock-on system.

The thickness control in the lock-on system is performed by calculating a thickness ho in the output side in the pass by the following equation to use it as a predetermined thickness ho in the pass.

$$ho = so + (F/M), \quad (1)$$

wherein

F: a rolling force in the rolling at the lock-on of the front edge of the slab between work rolls;

so: a roll gap at the non-loading; and

M: a mill constant.

In the conventional lock-on system, the following disadvantage is found.

Referring to the characteristic diagram of FIG. 1, the disadvantageous problem will be illustrated.

The rolling operation is performed from the front edge to the tail edge as a predetermined thickness by a thickness $ho_1$ in the output side at the intersection point Pc of a plastic characteristic curve (101) of the rolled slab and an elastic characteristic curve (102) of the rolling mill at the lock-on in the first pass. Thus, when the thickness fluctuation $\Delta h_1$ in the output side is caused depending upon the thickness fluctuation $\Delta H_1$ in the input side to give the thickness of the tail edge in the output side as $ho_1 + \Delta h_1$, a predetermined thickness at the lock-on in the next pass (a reversible rolling mill) is not $ho_2$ at the intersection point of the plastic characteristic curve (103) of the rolled slab and the elastic characteristic curve (104) of the rolling mill, but it is $ho_2 + \Delta h_{21}$ at the intersection point of the plastic characteristic curve (105) and the elastic characteristic curve (104) or $ho_2 + \Delta h_{21} \Delta h_{22}$ at the intersection point of the plastic characteristic curve (106) and the elastic characteristic curve (104) by adding the thickness fluctuation $\Delta H_2$ in the input side whereby accuracy of thickness is inferior.

The thickness fluctuation $\Delta H$ from the predetermined thickness in the last pass in the output side can be obtained by the following equation (2), however, there has not been any consideration of a time and a type of an output of adjusting degree of a screw gap depending upon the thickness fluctuation.

SUMMARY OF THE INVENTION

It is an object of the present invention to overcome the disadvantages in the lock-on system and to provide a feed forward automatic thickness controlling method which controls the thickness in higher thickness under controlling a screw gap at suitable time.

The present invention is to provide a feed forward automatic thickness controlling method which comprising (a) calibrating a thickness in the output side which is calcualted from a rolling force at a lock-on position in the present pass depending upon a fluctuation ($\Delta H$) from a predetermined thickness at a lock-on in the last pass, a deformation resistance (Q) of a rolled slab and a mill constant (M); and (b) controlling a constant lock-on level to give a predetermined thickness in the present pass as the same with the thickness in the output side given by a plastic characteristic curve of the rolled slab on the predetermined thickness at the lock-on in the last pass and an elastic characteristic curve of a rolling mill on a screw position in the present pass; (c) obtaining an adjusting degree of a screw gap of a press-down screw depending upon the thickness fluctuation from the predetermined thickness in the last pass, the mill constant and a differential coefficient in a rolling load function for the predetermined thickness in the present pass.

In a feed forward automatic thickness controlling method, the press-down screw position is controlled at the position corresponding to the position of the rolled slab in the last pass depending upon the adjusting degree by gaining for a time delay of the screw gap adjusting system comprising the press-down screw from the position corresponding to the position of the rolled slab in the last pass after obtaining the adjusting degree of the screw gap of the press-down screw.

In a feed forward automatic thickness controlling method, the press-down screw position is controlled depending upon the adjusting degree at the position corresponding to the position of the rolled slab in the last pass by providing a phase gain compensation to the time constant in the screw gap adjusting system after obtaining the adjusting degree of the screw gap of the press-down screw.

Thus, in a rolling mill for repeatedly rolling a slab, even though a thickness fluctuation in the output side from the lock-on position is caused, the lock-on position in the next pass can be precisely set while compensating for the fluctuation.

DETAILED DESCRIPTION OF THE PREFERRED EMBODIMENTS

Figure 1:
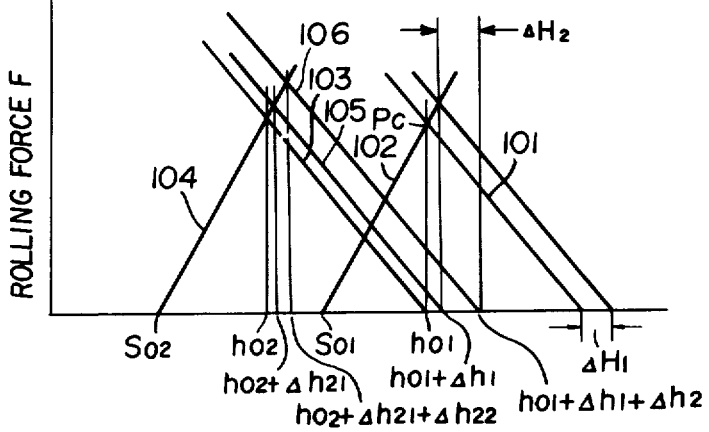
FIG. 1 is a characteristic diagram showing a relation between a thickness and a rolling force.
Figure 2:
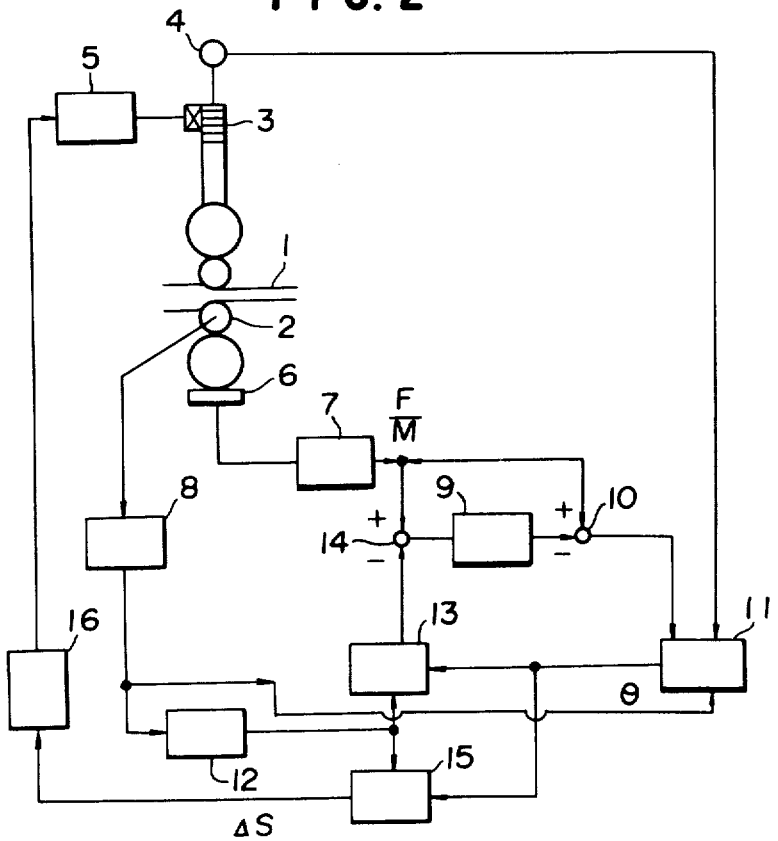
FIG. 2 is a block diagram of one embodiment of a feed forward automatic thickness controlling method of the present invention.

FIG. 2 is a block diagram of one embodiment of a feed forward automatic thickness controlling method of the present invention.

In FIG. 2, the reference numeral (1) designates a slab; (2) designates work rolls; (3) designates a press-down screw for adjusting a gap between work rolls; (4) designates a press-down screw level detector which detects a level of the press-down screw (3); (5) designates a screw driving device for driving the press-down screw; (6) designates a load cell for detecting a rolling load F; (7) designates an arithmetic unit for measuring an elongation F/M of a rolling mill; (8) designates a revolution angle detector for detecting revolution angle ($\theta$) of the work rolls; (9) designates a lock-on memory which memorizes a predetermined thickness for a lock-on calibrated by a lock-on level calibrator (13) as an elongation of the corresponding rolling mill on the revolution angle of the work rolls (2); (10) designates a comparator which measures a difference $\Delta F/M$ between an elongation Fo/M of the rolling mill in the lock-on and an elongation F/M of the rolling mill in the rolling work; (11) designates an arithmetic unit which (measures and memorizes) a thickness fluctuation $\Delta H(\theta)$ at the tail edge in the present pass, on the output of the revolution angle detector (8) by the equation:

$$\Delta H(\theta) = \frac{\Delta F(\theta)}{M} - \Delta S(\theta) \quad (2)$$

wherein $\Delta F(\theta)$: a deviation between the rolling pressure at the lock-on of the work rolls (2) and the rolling pressure at the revolution angle $\theta$ during the rolling work;

M: mill constant;

$\Delta S(\theta)$: a shifting distance in the position of the press-down screw in the lock-on at the position of the press-down screw at the revolution angle $\theta$ of the work rolls (2);

$\Delta H(\theta)$: a fluctuation of thickness from a predetermined thickness at the revolution angle $\theta$ of the work rolls (2)

(Usually, the angle $\theta$ is not considered as a lock-on edge.)

Thus, the arithmetic unit (11) also measures and memorizes a thickness fluctuation at the revolution angle ($\theta$) of the work rolls (2) by the equation (2) in the rolling work in this pass as well as that of the lock-on edge.

The reference numeral (12) designates a timing controlling device for controlling the timing for feed forward outputing, in the present pass, and the data of the thickness variation $\Delta H(\theta)$ memorized in the last pass.

Figure 3:
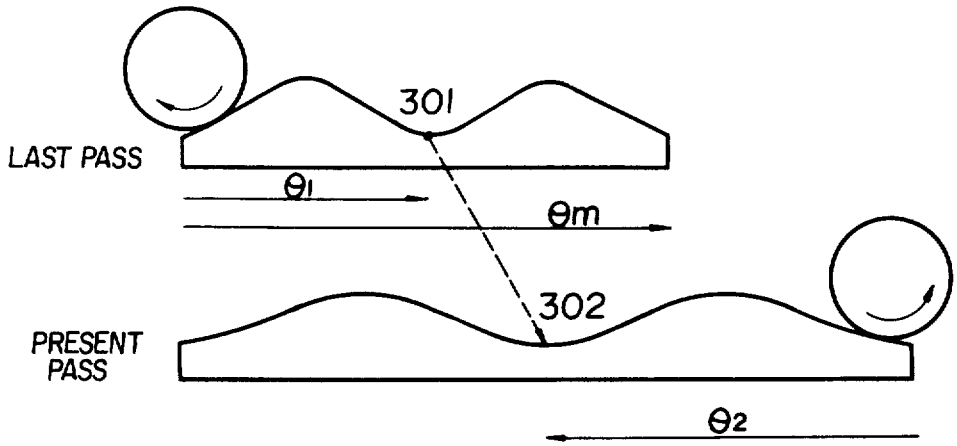
FIG. 3 is a schematic sectional view showing positions of a rolled slab in each pass.

Referring to FIG. 3, the operation of the timing controlling device will be illustrated.

When the point (301) of the rolled ingot in the last pass corresponds to the point (302) in the present pass, the relation is given by the equations (3), (4):

$$\theta_2 = K(\theta_m - \theta_1) \quad (3)$$

$$K = \frac{H}{h} \cdot \frac{1 + fn - 1}{1 + fn} \quad (4)$$

wherein $\theta_1$: a revolution angle of the work rolls from the lock-on edge of a slab to the point (301) in the last pass;

$\theta_m$: all revolution angles of the work rolls from the lock-on edge of the slab to the lock-out edge in the last pass;

$\theta_2$: a revolution angle of the work rolls from the lock-on edge of the ingot to the point (302) in the present pass;

K: an output timing conversion coefficient;

h: a predetermined thickness in the present pass;

H: a predetermined thickness in the last pass;

fn−1: a forward slip in the last pass; and fn: a forward slip in the present pass.

When the calculated revolution angle of the mill work rolls is $\theta_2$, the value of $\Delta H(\theta_2)$ corresponding to the thickness fluctuation $\Delta H(\theta_1)$ memorized in the last pass is fed to the lock-on level calibrator (13) and the press-down screw commanding device (15).

This shows a reversible rolling mill.

In the case of a tandem type rolling mill, when the revolution angle of the work rolls from the lock-on edge to the point (301) in the last pass is $\theta_1$ and the revolution angle of the work rolls from the same lock-on edge to the point (302) in the present pass is $\theta_2$, the following equation is given.

$$\theta_2 = \frac{H}{h} \cdot \frac{1 + fn - 1}{1 + fn} \cdot \theta_1 \quad (5)$$

The point (301) can be a discretional point.

A lock-on level calibrator (13) operates the following equation by $\Delta H(\theta_2)$ given by the equation (2) and is fed to a comparator (14).

$$\frac{Q}{M + Q} \Delta H(\theta_2)$$

(the revolution angle ($\theta_2$) shows the lock-on position) wherein Q=the deformation resistance That is, the lock-on memory (9) operates by the equation:

$$\frac{Fo(\theta_2)}{M} = \frac{F(\theta_2)}{M} - \frac{Q}{M + Q} \Delta H(\theta_2) \quad (6)$$

wherein $F(\theta_2)/M$: an elongation of the slab at the lock-on edge ($\theta_2$) in the present pass.

The screw press-down commanding device (15) commands screw press-down shifting distance $\Delta S^*$ depending upon $\Delta F/M$ and $\Delta S$.

The lock-on calibration is performed just after the lock-on whereby it is possible to operate as $\theta = 0$ at the lock-on edge regardless of the revolution angle $\theta$.

A time constant compensating device (16) in the press-down screw position controlling system operates as follows.

The output $\Delta S^*$ from the screw press-down device (15) is fed to the press-down screw driven device (5) under gaining for time delay $T_D$ in the screw gap adjusting system comprising the pressdown screw (3) and the press-down screw drive device (5).

The time constant compensating device has the phase gain compensating function having transfer function $$\frac{1 + T\rho S}{1 + RT\rho S} \quad (7)$$

($T\rho$, R: time constants of the screw gap adjusting system) to compensate the time delay in the screw gap adjusting system.

Figure 4:
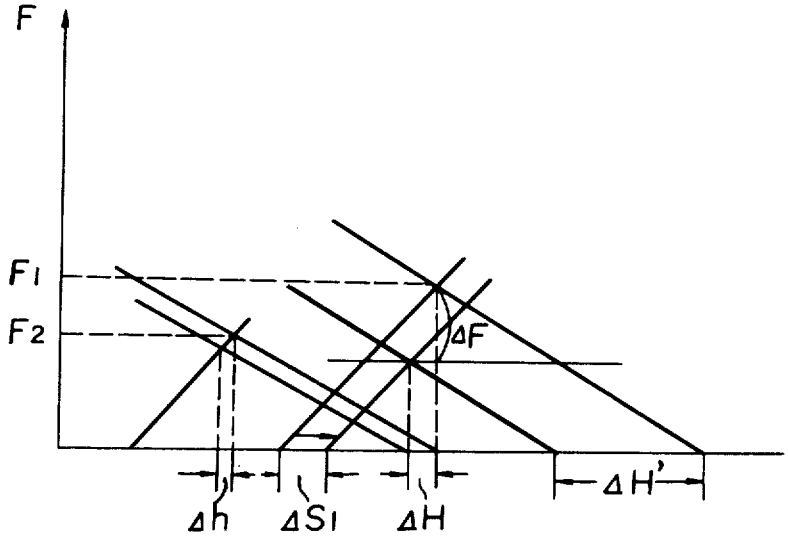
FIG. 4 is a characteristic diagram showing a relation between a thickness and a rolling force.

Referring to FIGS. 2 and 4, the operation of the embodiment having said structure will be illustrated.

When the thickness fluctuation $\Delta H'$ in the input side is found at the tail edge in the last pass (the front edge in the present pass), the thickness fluctuation $\Delta H$ in the output side is caused as shown in FIG. 4.

The thickness fluctuation $\Delta H(\theta)$ in the output side is given by the equation:

$$\Delta H(\theta) = \frac{\Delta F(\theta)}{M} - \Delta S1(\theta) \quad (8)$$

wherein $S1(\theta)$=the shifting distance in the first pass

When the thickness fluctuation $\Delta H$ in the input side is found at the front edge of the slab the thickness fluctuation $\Delta h$ in the output side is given by the equation:

$$\frac{Q}{M + Q} \Delta H(\theta)$$

Accordingly, in the present pass, the elongation $F_2/M$ of the rolling mill caused by the rolling force $F_2$ is calibrated as the equation.

$$\frac{Fo(\theta_2)}{M} = \frac{F_2(\theta_2)}{M} - \frac{Q}{M+Q}\Delta H(\theta_2) \quad (9)$$

by the lock-on level calibrator (13) depending upon the equation (6) and Fo/M is memorized in the lock-on memory (9).

As described above, at the lock-on, it is unnecessary to consider revolution angles $\theta_1$, $\theta_2$ as the lock-on edge.

The difference ΔF/M between the calibrated lock-on value Fo/M and the value F/M detected in the present pass, is fed into the arithmetic unit (11) wherein the thickness fluctuation $\Delta H(\theta_2)$ is memorized under the relation of the revolution angle ($\theta_2$) of the work rolls (2) depending upon the equation (2) and also the thickness fluctuation $\Delta H(\theta_1)$ memorized in the last pass, is taken out and operated by the screw press-down commanding device (15) depending upon the equation (10) to give the command ΔS* of the press-down screw shifting distance through the time constant compensating device (16) to the screw press-down device (5) by the timing controlling device (12) at the position of the revolution angle $\theta_2$ corresponding to the revolution angle $\theta_1$.

$$S^*(\theta_2) = \frac{\frac{\partial F}{\partial ho_2}}{M} \cdot \Delta H(\theta_1) \quad (10)$$

wherein

F: a rolling load function calculated by the schedule calculation under variable of a thickness h or a temperature T of steel slab;

$\partial F/\partial ho_2$: a differential coefficient corresponding to deformation resistance Q for a thickness $ho_2$ in the output side in the present pass for the rolling load function.

The time constant compensating device (16) compensates the time delay in the screw gap adjusting system and then outputs to the screw press-down device.

The screw press-down device (5) drives the press-down screw (3) depending upon the adjusting degree given by the equation (7) at the position for the revolution angle ($\theta_2$) of the work rolls (2) in the present pass. The control in the next pass is also performed in the same manner.

We claim:

1. A feed forward automatic thickness controlling method for a slab which makes multiple passes through a rolling mill, said method comprising:

calibrating a thickness at the output side of a predetermined pass as a function of a rolling force at a lock on a position in said predetermined pass, said rolling force being a function of a fluctuation from a predetermined thickness in the previous pass of said slab, a deformation resistance of said slab and a mill constant;

controlling said constant lock-on level to provide said calibrated predetermined thickness in said predetermined pass, said lock on level being determined by the intersection of a plastic characteristic curve of said rolled slab at the lock on position in the previous pass of said slab and an elastic characteristic curve of said rolling mill at a press-down screw position in said predetermined pass;

obtaining an adjusting degree of a screw gap of said pressdown screw as a function of the thickness fluctuation from the predetermined thickness in said previous pass of said slab, a mill constant and a differential coefficient of a rolling load function for the predetermined thickness in said predetermined pass; and controlling said press-down screw position as a function of said adjusting degree.

2. The method of claim 1 wherein said adjusting degree is controlled in a position corresponding to the position of said rolled slab in said previous pass by accounting for a time delay in said screw gap adjusting system.

3. The method of claim 1 wherein said adjusting degree is controlled in a position corresponding to the position of said rolled slab in said previous pass by compensating the time constant control of said screw gap adjusting system for the phase gain from said previous pass to said predetermined pass.

* * * * *